US006196543B1

(12) United States Patent
Cornett

(10) Patent No.: US 6,196,543 B1
(45) Date of Patent: Mar. 6, 2001

(54) BOARD GAME KIT

(76) Inventor: Eugene P. Cornett, 8149 Lower Bay La., Indianapolis, IN (US) 46236

( * ) Notice: Subject to any disclaimer, the term of this patent is extended or adjusted under 35 U.S.C. 154(b) by 0 days.

(21) Appl. No.: 09/636,441

(22) Filed: Aug. 11, 2000

Related U.S. Application Data

(60) Division of application No. 09/369,785, filed on Aug. 6, 1999, now abandoned, which is a continuation-in-part of application No. 09/132,857, filed on Aug. 11, 1998, now abandoned.

(51) Int. Cl.[7] ..... A63B 71/04; B65D 85/00; B65D 33/16; B65B 67/04; A63F 3/00

(52) U.S. Cl. ..... 273/148 R; 206/315.1; 206/579; 248/99; 273/236; 273/272; 383/43; 383/75; 383/118

(58) Field of Search ..... 383/43, 71, 72, 383/74–76, 118; 273/148 R, 146, 157 R, 285, 286, 236, 272; 206/315.1, 579; 248/97, 99

(56) References Cited

U.S. PATENT DOCUMENTS

| | | | | |
|---|---|---|---|---|
| 1,092,955 | * | 4/1914 | Shaver | 383/75 X |
| 1,535,732 | * | 4/1925 | Malm | 383/76 X |
| 2,037,175 | * | 4/1936 | Northerass | 383/43 |
| 2,319,384 | * | 5/1943 | Callen et al. | 248/99 X |
| 2,479,203 | * | 8/1949 | Brown | 383/72 |
| 2,520,343 | * | 8/1950 | Saum | 383/76 X |
| 2,585,214 | * | 2/1952 | Belmont | 383/43 |
| 2,598,334 | * | 5/1952 | Ahlburg | 383/76 X |
| 3,475,767 | * | 11/1969 | Fresen et al. | 383/75 X |
| 3,599,690 | * | 8/1971 | Christie | 383/72 X |
| 4,457,483 | * | 7/1984 | Gagne | 248/97 |
| 4,743,031 | * | 5/1988 | Lamle | 273/146 |
| 4,953,704 | * | 9/1990 | Cortese | 383/43 X |
| 4,977,941 | * | 12/1990 | Henderson | 150/112 |
| 5,056,679 | * | 10/1991 | Lonczak | 248/97 X |
| 5,207,425 | * | 5/1993 | Cohrs | 273/148 R |
| 5,232,118 | * | 8/1993 | Samuel | 383/43 X |
| 5,308,080 | * | 5/1994 | Lamle | 383/74 |
| 5,400,989 | * | 3/1995 | Gaskill | 248/97 |
| 5,419,569 | * | 5/1995 | Lamle | 383/74 X |
| 5,529,395 | * | 6/1996 | French | 383/75 |
| 5,996,999 | * | 12/1999 | Casely | 273/148 R |

FOREIGN PATENT DOCUMENTS

| | | | | |
|---|---|---|---|---|
| 0765392 | * | 6/1934 | (FR) | 383/75 |

OTHER PUBLICATIONS

USPTO website printout of Catch–em® registration information, Sep. 10, 1999 owned by Avis J. Casely and photos of product marked with the Catch–EM® mark.

* cited by examiner

*Primary Examiner*—Bryon P. Gehman
(74) *Attorney, Agent, or Firm*—Ice Miller; Jay G. Taylor; Russell E. Fowler, II

(57) ABSTRACT

A board game bag is made of non-transparent flexible material and includes a main body and a mouth. An elastic member is disposed within the mouth, allowing the mouth to open when the elastic member is stretched and causing the mouth to partially close when the elastic member is allowed to relax. The board game bag is designed to hold game pieces to be drawn during game play. To this end, the board game bag is placed in a cylindrical plastic sleeve that provides support for the bag so that the bag is held upright as players draw game pieces from the bag. Following game play, all game pieces placed on the board are easily removed from the board by stretching the mouth of the bag over all four corners of the game board and flipping the board over, thus causing the game pieces to fall into the bag. The mouth of the bag is then removed from the four corners of the board and the elastic member causes the mouth of the bag to constrict. The mouth of the bag may be totally closed by pulling a portion of the elastic member from the mouth, giving the pulled portion of the elastic member a half-turn to form a loop, and placing the loop over the mouth. Thus, a board game bag is provided that serves as a storage bag, a blind draw bag during game play, and a quick clean up bag following game play.

13 Claims, 3 Drawing Sheets

BOARD GAME KIT

CROSS REFERENCE TO RELATED APPLICATIONS

This application is a divisional of U.S. patent application Ser. No. 09/369,785, filed Aug. 6, 1999, now abandoned which is a continuation-in-part of U.S. patent application Ser. No. 09/132,857, filed Aug. 11, 1998 now abandoned.

BACKGROUND OF THE INVENTION

The present invention relates to the field of board games. More particularly, the present invention relates to accessories for use with board games having multiple pieces that are drawn from a bag during the course of play.

Individuals throughout the world enjoy playing board games. Many of these board games include numerous game pieces that are randomly drawn during game play for placement on the game board and must be cleaned from the board following play. For example, the popular word games SCRABBLE® and UPWORDS® both include numerous game pieces or "tiles" having letters on each game piece. During play of the game, tiles are drawn by each player and played on the game board until all pieces have been drawn, played and remain on the board. It is typically important under the rules of such games that players are not allowed to look at the letter on a tile before it is chosen. Thus, players sometimes turn all of the tiles to be used during the game face down before they are drawn so that a player can not see the letter on any given tile before he or she chooses the tile. However, turning every game tile on its face can be a very tedious task which takes a significant amount of time. Therefore, rather than turning each game tile on its face, many players prefer to use a drawing bag from which tiles are blindly drawn as required during game play.

Game manufacturers often provide game piece storage bags that may also be used as drawing bags during game play. A typical storage bag provided with such a game is made of two pieces of non-transparent rectangular plastic. The two pieces of plastic are joined along three of the edges to form three seams with one edge left open, thus forming a bag for the game tiles. One such bag included with many SCRABBLE® games measures approximately 6.75 inches× 7.25 inches and includes an additional 1.75 inch flap attached to one of the rectangular plastic pieces for folding over the bag opening and closing the opening during storage of the tiles. The bag may also be used as a drawing bag as it is non-transparent and is large enough for an average sized human to place his or her hand into the bag, grasp a tile, and remove his or her hand from the bag. The design of these bags is relatively simple and the bags are constructed of inexpensive parts, thus allowing the bags to be produced by the manufacturer with little expense. However, because the size of the bag opening is not flexible, and because the bag is a relatively small size, those with larger hands may experience some difficulty in placing their hand into the bag and grasping a tile. This is especially true if there are only a few tiles remaining in the bag such that the larger hand is required to reach all the way into the corners of the bag to obtain a tile. In addition, because the bag opening is inflexible and designed cheaply with inexpensive materials, the stresses placed on the relatively small, inflexible opening causes the bag to begin to tear along the seams at the bag opening following repeated placement of hands into the bag. Thus, it would be useful to provided a well constructed storage/drawing bag that could be produced cheaply while still providing a durable bag capable of accommodating players with hands of various sizes.

Another problem with the typical drawing bags provided by game manufacturers is that tiles easily escape the bag during game play. When drawing a tile from the bag, a player must pick up the bag, draw a tile from the bag and return it to the game table. When the player lays the bag down, much care must be taken to prevent tiles from escaping the bag. If the bag is laid down too quickly, a tile may easily slide along the plastic and out of the bag where it is exposed to all of the players. Thus, it would be useful to provide a drawing bag that would stand upright so that tiles held by the bag do not fall out of the bag during game play and players do not need to pick up the bag every time a tile is drawn.

Upon completion of a game, all or most of the game tiles have been placed on the game board, and the players are faced with the chore of picking up each and every tile and placing the tiles in the storage bag where the tiles are kept until further play is desired. Instead of picking up tiles individually, some players tip the game board and attempt to slide the tiles directly into the bag or to a central area where the pieces are more easily collected. Of course, allowing the tiles to slide from the board sometimes results in "runaway" tiles that do not end up in the desired location and fall to the floor where the tile is easily lost. Additionally, some game boards are constructed to prevent tiles from sliding from the playing surface, and thus the surface of the board can not be cleaned by simply tilting the board and allowing pieces to slide off. These game boards typically include a grid of plastic ribs that form indents or seats for the tiles and keep the tiles in place during play of the game should the game board be jarred, shaken or bumped. The tiles placed on these boards must be removed one-by-one and placed in the drawing bag.

One prior art device that attempts to solve the problem of players needing to remove pieces one-by-one from game boards is disclosed in U.S. Pat. No. 5,207,425 to Cohrs. The Cohrs patent discloses a plastic or cardboard device for handling game pieces to be cleaned from a game boards having indents for the game pieces. The device includes a base portion that fits over the edges of the game board. When the game board is flipped over, the game pieces fall into the base portion and funnel into a centrally located chimney. If a storage bag is fitted over the chimney, the game pieces may be funneled directly into the storage bag, thus making the player's task of removing game pieces from the game board easier. Unfortunately, the Cohrs device is a rather large rigid device which does not fit easily into a game box. Thus, if the Cohrs device is to be used to clean up a game, a player must remember the device, locate it and tote the device along with the game to the location of game play. Alternatively, if the device is to be stored in the game box, several steps must be taken to assemble and disassemble the device each time it is used. This only makes the task of cleaning up after game play more difficult. Therefore, the need exists for a clean up device that is easily and conveniently stored in a game box. Ideally, the device could also be used as a drawing bag such that removal of the game pieces from the game board following game play would result in game pieces being placed directly in the drawing bag, thus allowing for the immediate starting of a new game or immediate storage until further play is desired.

SUMMARY OF THE INVENTION

A board game bag according to the present invention includes a bag member having a main body and a mouth. The main body of the bag member is constructed from a substantially circular piece of cloth, plastic or other flexible material. The circumferential portion of the flexible material forms the bag mouth. The mouth of the bag member includes a channel formed by a hem about the circumferential portion of the flexible material. An elastic member is disposed within the hem channel and acts to constrict the mouth and draw the circumferential portion of the flexible material together to form a bag when the elastic member is in a relaxed state. When the elastic member is fully stretched, the mouth completely opens such that the circular shape of the flexible material is exposed.

During game play, the bag member is placed within a support member. The support member comprises a cylindrical plastic sleeve having an interior wall, exterior wall and a top rim. The main body of the bag member is positioned within the cylindrical sleeve and the mouth of the bag member is folded over the top rim of the cylindrical sleeve. When the mouth of the bag member is folded over the top rim of the cylindrical sleeve, the elastic member is in a slightly stretched state. Therefore, the elastic member causes the mouth of the bag to constrict against the exterior wall of the cylindrical sleeve and the bag remains in place upon the cylindrical sleeve. The cylindrical sleeve provides support for the bag and allows the bag to be used as a free-standing drawing bag from which players may draw game pieces during game play.

Following game play, all or most of the game pieces are situated upon the game board. In order to easily remove the game pieces from the board, the mouth of the bag is stretched over the four corners of the game board and the board is flipped. This causes all of the game pieces to fall into the bag. Following this, the mouth of the bag is removed from the corners of the board and the elastic member is allowed to return to a relaxed state. All game pieces are therefore easily collected and contained within the bag following game play. The present invention is particularly useful with game boards having a rimmed grid or other such framework on the surface which provides seats for the playing pieces. One such grid is included on deluxe versions of the game SCRABBLE®.

Accordingly, one advantage of the present invention is to provide a device for use during games that require game pieces to be blindly drawn during game play. The drawing device is a free standing device that prevents the escape of game pieces from the bag and also serves as a storage bag for the game pieces.

Another advantage of the present invention is that the drawing device may also be used as a retrieval means which provides a quick and easy clean up of game pieces following game play.

DETAILED DESCRIPTION OF THE INVENTION

Figure 1:
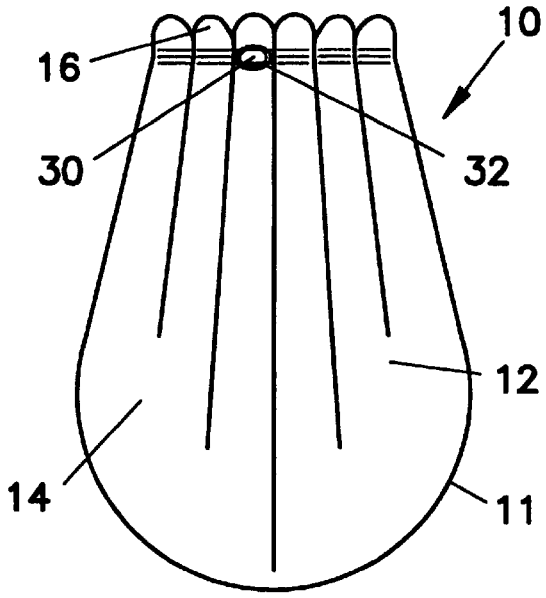
FIG. 1 is a side view of a board game bag with the mouth open.
Figure 2:
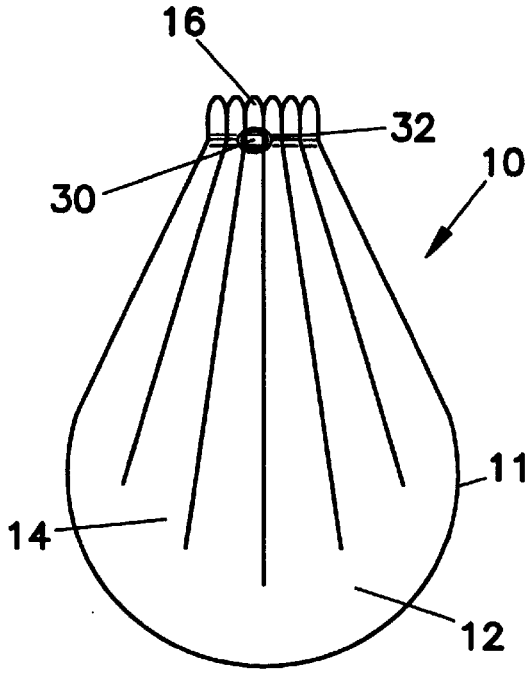
FIG. 2 is a side view of the board game bag of FIG. 1 with the mouth closed.

As shown in FIGS. 1 and 2, the present invention is a board game bag 10 having a bag member 12 including a main body 14 and a bag mouth 16. A constricting means in the form of an elastic member 30 is disposed in the bag mouth 16 to allow opening and closing of the mouth 16. The bag 10 is designed to hold various pieces of a game for storage following game play or as a drawing bag from which the game pieces are drawn during game play. Additionally, the bag 10 serves as a device for retrieving pieces from a game board 50 (see FIG. 7) following game play. After pieces are retrieved from the game board following game play, the game bag 10 may be easily stored in the game box (not shown) along with all of the game pieces neatly contained within the game bag 10.

The bag member 12 is made of a flexible material 11 such as fabric cloth or plastic. The flexible material 11 should be non-transparent (e.g., opaque, translucent or of sufficient weave density) to prevent players from seeing into the bag 10 when it is used as a drawing bag. Examples of acceptable material for use as the bag member include soft flannel cloth, linen cloth, and thin plastic. If plastic is used as the flexible material, it is preferable to use a slightly textured plastic of about 0.01 inches in thickness. Textured plastic, or plastic with a similar surface, is preferred because the texture helps the plastic adhere to the game board when the bag member is stretched over the game board, as described below.

Figure 3:
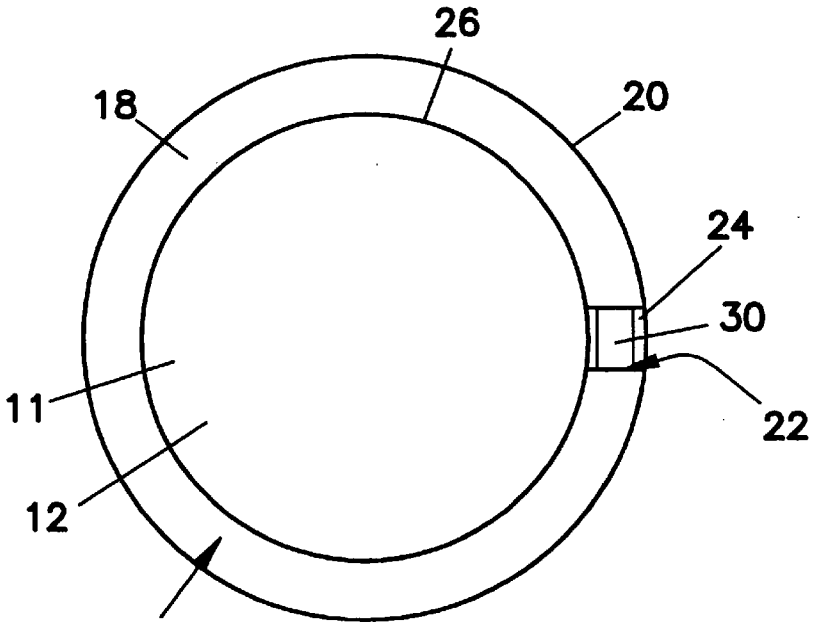
FIG. 3 is a top view of a game board with the board game bag of FIG. 1 laid completely flat.

As shown in FIG. 3, the shape of the bag member 12 is a substantially circular when laid completely open. The bag member 12 is approximately twenty-seven inches (27") in diameter. A hem 18 of approximately one inch (1") is formed in the flexible material 11 around the periphery 20 of the bag member 12, leaving an inner circle of approximately twenty-five inches (25") in diameter within the hem and an outer circle of approximately 27 inches (27") in diameter outside the hem.

A channel 22 is formed within the hem 18 for accepting the elastic member 30. A hem opening 24 provides access to the elastic member 30 disposed within the channel. The hem 18 and associated channel 22 may be formed by any method as is known in the art. For example, if two pieces of flexible material are laid directly upon each other and stitched, welded, glued, or otherwise connected along the periphery and an inner circle 26 of the bag member concentric to the periphery 20, a hem will be formed with an associated channel 22 within the hem between the two pieces of flexible material. If the hem 18 is formed in this manner, the main body 14 of the bag member 12 will comprise two layers of flexible material 11. Of course the hem 18 and channel 22 may also be formed by other means such as connecting a separate ring of material to the circular piece of flexible material along the periphery 20 and inner circle 26 in order to form the hem and channel, or folding the periphery of the flexible material slightly inward toward the center of the flexible material to form the hem and channel.

The elastic member 30 is made of a rubber band, such as a BIG BANDS™ brand rubber band made by the Alliance Rubber Company of Hot Springs, Ark. Alternatively, the elastic member 30 may be made of surgical latex or other elastic material having a stretch ratio of five (5) or more times its length when stretched as compared to its length when in a relaxed state. When the elastic member 30 is placed in the hem channel 22, the bag member 12 is drawn together around the periphery 20 to form the mouth 16. When the elastic member 30 is in a relaxed, un-stretched state, an opening exists in the mouth 16 of approximately five inches (5") in diameter, which is a sufficient size to allow a human hand into the bag interior with little or no stretching of the elastic member 30. When the elastic member 30 is fully stretched, the mouth 16 may be opened to nearly the full size of the circumferential edge of the bag member 12 such that the main body of the bag completely covers a typical SCRABBLE® game board of approximately fifteen and a half inches (15.5") by fifteen and a half inches (15.5"). Of course, the dimensions of the bag member are such that it may also be used with slightly larger or smaller boards.

A portion of the elastic member 30 may be drawn through the hem opening 24 to further constrict the mouth 16 beyond the point at which the elastic member 30 is relaxed. A bead 32 may optionally be included on the elastic member 30 at the hem opening 24 to provide a clasp for use when drawing the elastic member 30 from the hem opening 24. The bead 32 includes a hole through which the elastic member is strung. In order to decrease the size of the mouth 16 beyond the size when the elastic member 30 is in a relaxed state, a portion of the elastic member 30 is pulled out from the channel using the bead 32 at the hem opening. The pulled out portion is then rotated one hundred and eighty degrees, thereby forming a second loop of the elastic member 30, and stretched over the entire mouth 16 of the bag thereby achieving closure of the bag as shown in FIG. 2.

Figure 4:
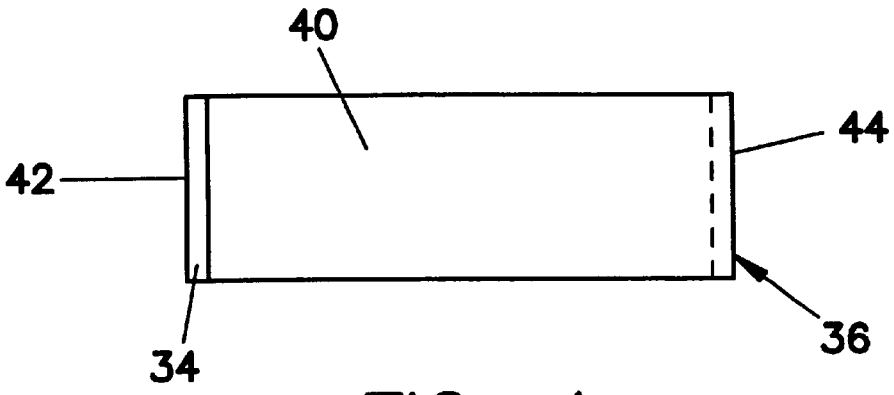
FIG. 4 is a side view of an unassembled plastic sleeve according to the present invention.
Figure 5:
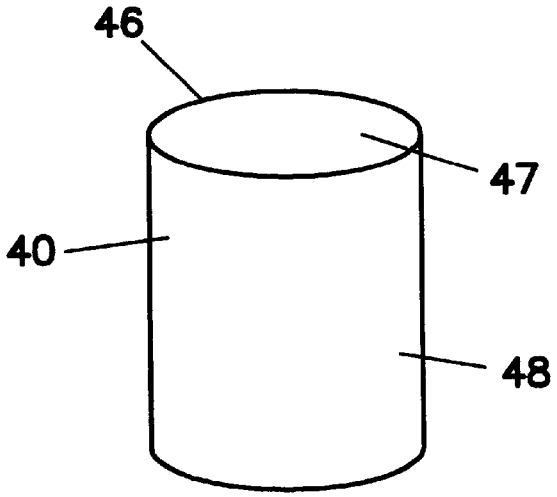
FIG. 5 is perspective view of an assembled plastic sleeve according to the present invention.
Figure 6:
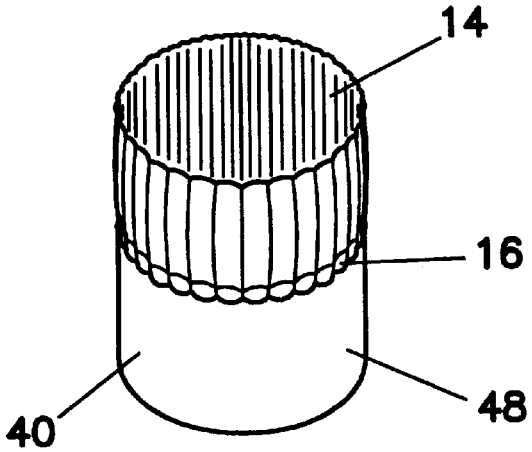
FIG. 6 is a perspective view of the board game bag of FIG. 1 situated in the assembled plastic sleeve of FIG. 5.

A support member in the form of a plastic sleeve 40 is also provided for use with the present invention. As shown in FIGS. 4 and 5, the plastic sleeve 40 when unassembled is a rectangular sheet of semi-rigid plastic material having two ends 42 and 44. The rectangular sheet of plastic material is approximately fifteen and a half inches (15.5") long between the ends and six inches (6") high at the two ends. Fastening strips 34 and 36 are placed along the height of each end of the plastic sheet on opposite sides of the plastic sheet. The fastening strips 34 and 36 are preferably hook and complementary loop type fasteners, such as VELCRO® fasteners. The fastening strips are attached to the ends of the plastic sheet by adhesive or other connecting means such as staples or rivets. Joining the two fastening strips 34 and 36 causes the plastic sheet to form a holding cylinder or sleeve 40 for the game bag, the sleeve having a diameter of approximately five inches (5"). The sleeve 40 includes a top rim 46, an inner cylindrical wall 47 and an outer cylindrical wall 48. When the main body 14 of the bag is placed into the plastic sleeve 40, and the bag mouth 16 is folded over the top of the plastic sleeve, the bag is held upright as shown in FIG. 6. The elastic member 30 causes the mouth 16 of the bag to lightly grasp the cylinder of the plastic sleeve, thereby holding the bag in place upon the sleeve 40.

The plastic sleeve 40 may be easily disassembled by parting the fastening strips 34 and 36 on the ends 42 and 44 of the plastic sheet. Once disassembled, the plastic sheet lays flat for storage inside the game box along with the game bag. In addition to use as a holding cylinder, the plastic sleeve may be used to print rules, advertisements, or other information or designs to be viewed by game players.

The board game bag 10 is used as a convenient accessory for use with the play of board games requiring a blind draw of game pieces. At the start of game play, the bag 10 is removed from the game box with the bag containing all of the game pieces for drawing during the course of game play. The plastic sleeve 40 is also removed from the game box and assembled into cylindrical form by attaching the fastening strips 34 and 36 on the ends of the plastic sheet. Next the game bag is inserted into the plastic sleeve and the mouth 16 of the bag is stretched and folded over the top rim 46 of the sleeve. The elastic member 30 constricts the mouth 16 of the bag against the outer wall 48, and secures the bag in place on the sleeve 40. In this manner the bag is held upright so that players may reach into the bag and draw game pieces during game play. The plastic sleeve 40 is designed to hold the bag high enough so a seated player will have difficulty looking into the bag and seeing what game pieces he or she is drawing when the bag is on a game table. In addition, the size and flexible quality of the main body of the bag causes it to puff within the cylindrical sleeve, further preventing a player from seeing what game pieces he or she is drawing.

Figure 7:
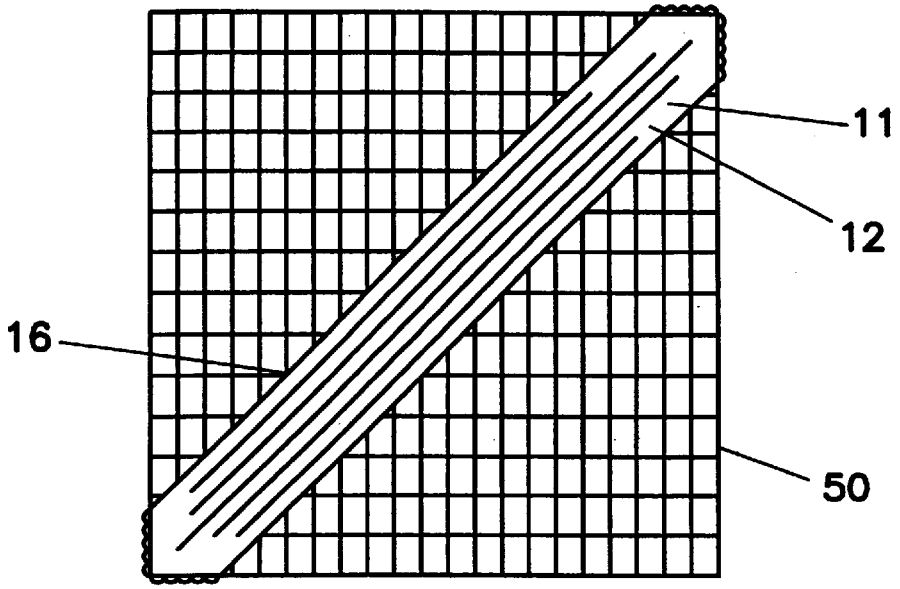
FIG. 7 is a top view of a game board showing the board game bag of FIG. 1 being extended over two opposing game board corners.
Figure 8:
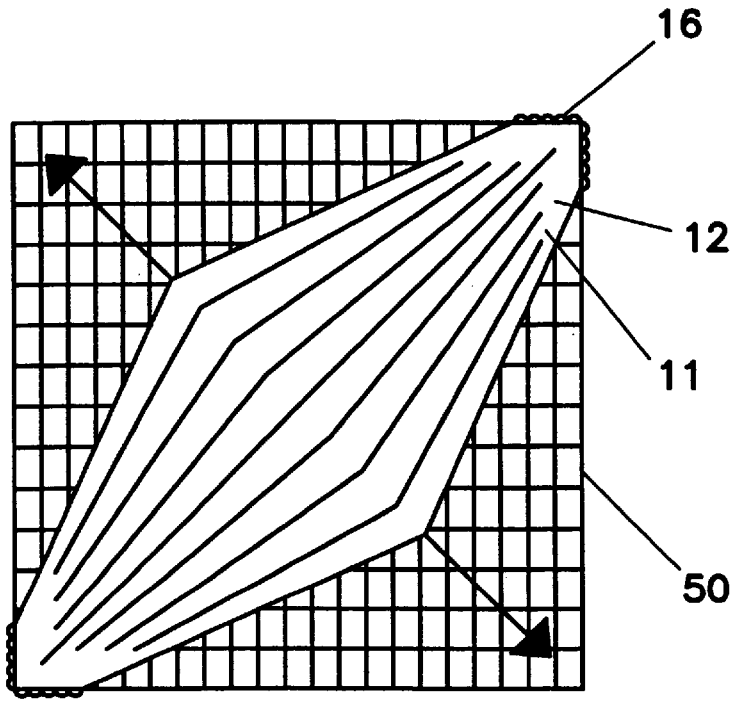
FIG. 8 is a top view of a game board showing the board game bag of FIG. 1 being extended over the entire game board.

Once all of the game pieces have been drawn from the bag and the game is complete, the bag 10 is removed from the plastic sleeve 40. In order to easily retrieve the game pieces from the game board, the mouth 16 of the bag is stretched over two opposing corners of the game board 50 as shown in FIG. 7. Preferably, the bag is stretched over the two opposing corners of the game board simultaneously to avoid one end slipping off of a corner and flipping game pieces from the board. Next, the mouth 16 of the bag is further stretched over the remaining two corners of the game board as shown in FIG. 8. With the mouth 16 of the bag completely covering the edges and corners of the game board, the game board is flipped over so that the game pieces are dumped into the main body 14 of the bag. The mouth 16 of the bag is then removed from the edges of the game board by removing the mouth 16 of the bag from the corners of the game board, and allowing the elastic member 30 to return to a relaxed condition. As the elastic member 30 pulls the mouth 16 of the bag together, all of the game pieces are enclosed and contained by the bag member 12.

In this manner, all game pieces are easily collected from the game board following game play and conveniently placed in a drawing/storage bag. If the players wish to continue play with a new game, the bag is simply returned to the plastic sleeve 40 and the players may immediately begin drawing pieces for the new game. Alternatively, if the game is to be put away, all game pieces are already in a convenient storage bag. The bag may be completely closed to prevent any pieces from escaping the bag during storage by pulling the elastic member 30 through the hem opening, rotating the elastic member 30 one hundred and eighty degrees (180°) to form a second loop, and wrapping the second loop around the outside of the bag.

Those of skill in the art will appreciate that many changes could be made to the embodiments described herein without departing from the spirit and scope of the invention. By way of example, the flexible material used to make the bag member 12 could be some type of stretchy cloth such as spandex or nylon. This would further allow the bag to stretch across a typical game board and facilitate removal of game pieces from the board. Additionally, instead of using fastening strips, slits could be cut on opposite ends of the plastic sheet, thus allowing the ends to be joined along the slits when assembling the plastic sleeve. Additional changes will be readily apparent to those of skill in the art and the invention, as described in the claims, should not be limited to the embodiments shown.

What is claimed is:

1. A board game kit for use by a game player in handling game pieces, the board game kit comprising:

a. a game board having four corners and a game board face for receiving game pieces thereon;

b. a bag for removing the game pieces from the game board and holding the game pieces when they are not positioned upon the game board, the bag having i. a main body comprised of a flexible material;

ii. an adjustable mouth integral with the main body, the mouth adjustable between a contracted opening and an expanded opening, the contracted opening dimensioned to an opening of sufficient size to allow entry of a human hand with little or no stretching of the elastic member, thereby allowing game board pieces to be retrieved from said bag, and the expanded opening being dimensioned to fit over and receive said game board therein with said face and game pieces thereon being inside said bag;

iii. an elastic member disposed peripherally of the mouth for adjusting size variations of the mouth between the contracted opening when the elastic member is relaxed and the expanded opening when the elastic member is almost fully stretched.

2. The board game kit of claim 1 wherein the game board is dimensioned to about fifteen and a half inches by fifteen and a half inches.

3. The board game kit of claim 2 wherein the game board face includes a grid of plastic ribs forming seats for the game pieces.

4. The board game kit of claim 3 wherein the game pieces are tiles having letters printed thereon.

5. The board game kit of claim 1 further comprising a bag support with a top rim having a diameter such that the bag may be placed in the bag support with the mouth held open by the top rim, thereby allowing players to draw game pieces from the bag.

6. A method for collecting game pieces from a game board face and placing them into a container such that players may blindly draw the game pieces from the container, the method comprising the steps of:

a. providing a game board and a drawing bag, the drawing bag having a main body comprised of a non-transparent flexible material and a mouth integral with the main body, the mouth dimensioned to fit over a face of the game board, the further comprising an elastic member disposed peripherally of the mouth of the bag, the elastic member maneuverable to vary the size of the mouth such that the mouth will open to cover the face of the game board when the elastic constricting member is stretched and constrict to an opening of sufficient size to allow entry of a human hand with little or no stretching of the elastic member when the elastic member is relaxed;

b. stretching the elastic member to cause the mouth of the bag to cover the game board face;

c. flipping the game board up-side-down such that the game pieces on the game board face fall into the bag:

d. removing the mouth of the bag from the game board face and allowing the elastic member to constrict the mouth of the bag such that game pieces may be blindly drawn from the bag.

7. A method of utilizing game pieces during the play of a game, wherein the game pieces are drawn blindly by each player during game play and positioned upon the face of a game board, the method comprising the steps of:

a. providing game pieces in a bag having a mouth and a mouth opening with a constricting means disposed peripherally to the mouth, the constricting means acting to increase or decrease the size of the mouth opening;

b. drawing game pieces from the bag during game play;

c. placing game pieces drawn from the bag on a game board during game play;

and d. retrieving game pieces from the game board after game play by causing the constricting means to increase the size of the mouth opening and inserting the game board therethrough such that the bag substantially covers the game board, flipping the game board up-side-down such that game pieces on the game board fall into the bag, removing the mouth of the bag from the game board, and allowing the constricting means to decrease the size of the mouth opening.

8. The method of claim 7 further comprising the step after step b and before step b of placing the bag within a bag support having a top rim and an outer wall and folding the mouth over the top rim of the bag support such that the constricting means applies pressure to the outer wall of the support member.

9. The method of claim 8 further comprising the step after step c and before step d of removing the bag from the bag support.

10. The method of claim 9 further comprising the step of assembling the bag support after step a and before step b and before placing the bag within the bag support by joining two opposing ends of a rectangular plastic sheet to form a plastic sleeve.

11. The method of claim 10 further comprising the additional step of placing the bag in a game box for storage of the bag and game pieces within the bag, disassembling the support member and placing the support member in the game box.

12. The method of claim 7 further comprising the additional step after step d of pulling a portion of the constricting means away from the mouth, turning the pulled portion of the constricting means 180 degrees to form a loop, and flipping the loop around the mouth to further constrict the mouth.

13. The method of claim 12 wherein the act of flipping the loop around the mouth to further constrict the mouth allows the bag to serve as a storage device for the game pieces.

* * * * *

UNITED STATES PATENT AND TRADEMARK OFFICE

CERTIFICATE OF CORRECTION

PATENT NO. : 6,196,543 B1
DATED : March 6, 2001
INVENTOR(S) : Eugene P. Cornett

It is certified that error appears in the above-identified patent and that said Letters Patent is hereby corrected as shown below:

Claim 8,
Line 2, please replace "step b and before step b" with -- step a and before step b --.

Column 4,
Line 35, please replace "a substantially circular" with -- substantially circular --.

Signed and Sealed this

Sixth Day of November, 2001

*Attest:*

Nicholas P. Godici

*Attesting Officer*

NICHOLAS P. GODICI
*Acting Director of the United States Patent and Trademark Office*